US007223012B2

(12) United States Patent
Cheng

(10) Patent No.: US 7,223,012 B2
(45) Date of Patent: May 29, 2007

(54) BULB ASSEMBLIES OF LIGHT STRING WITH VARIOUS CONNECTIVE STATUS

(76) Inventor: Hung-Huei Cheng, 2F, No. 99, Chueng Chieng North Road, Taipei City (TW)

( * ) Notice: Subject to any disclaimer, the term of this patent is extended or adjusted under 35 U.S.C. 154(b) by 67 days.

(21) Appl. No.: 11/114,149

(22) Filed: Apr. 26, 2005

(65) Prior Publication Data

US 2006/0239014 A1 Oct. 26, 2006

(51) Int. Cl.

| | |
|---|---|
| ***H01R 33/00*** | (2006.01) |
| ***F21S 13/14*** | (2006.01) |
| ***F21S 13/02*** | (2006.01) |
| ***F21V 17/00*** | (2006.01) |

(52) U.S. Cl. ..... 362/657; 362/252; 362/448; 362/457

(58) Field of Classification Search ..... 315/185 R, 315/185 S, 312; 362/232, 233, 234, 235, 362/249, 252, 448, 457, 647, 652, 653, 657; 439/374, 375

See application file for complete search history.

(56) References Cited

U.S. PATENT DOCUMENTS

| | | | | |
|---|---|---|---|---|
| 5,513,081 | A * | 4/1996 | Byers | 362/145 |
| 6,910,918 | B1 * | 6/2005 | Driver | 439/542 |
| 7,052,159 | B2 * | 5/2006 | Wu | 362/252 |
| 2003/0156408 | A1 * | 8/2003 | Goodman | 362/234 |

* cited by examiner

*Primary Examiner*—Thuy Vinh Tran
(74) *Attorney, Agent, or Firm*—Rosenberg, Klein & Lee

(57) ABSTRACT

The invention relates to a light string having bulb assemblies with various connective statuses, wherein the bulb assembly includes a shell to receive the bulb holder and the bulb. The shell is provided with a male flange and a female groove for connecting with another groove and another flange of related shells respectively. The connective bulb assemblies of the light string display a stable outlook, which is also variable by adjusting the connecting position between the bulb assemblies, to provide various decorative effect.

4 Claims, 2 Drawing Sheets

BULB ASSEMBLIES OF LIGHT STRING WITH VARIOUS CONNECTIVE STATUS

FIELD OF THE INVENTION

The present invention relates to a light string, wherein the bulb assemblies of the string can be connected together to form various connective outlooks for increasing decorative effect.

BACKGROUND OF THE INVENTION

A conventional light string includes an electrical wire connecting with a plurality of bulb assemblies, which provide lighting for special decoration at all. Since the electrical wire is soft and each bulb assembly is connected with the wire in interval, a rigid frame should be provided for hanging the string in order to position the bulb assemblies at desired place. This is very inconvenient.

SUMMARY OF THE INVENTION

The present invention is to provide an improved light string, which has invented bulb assembly being capable of connecting with each other together easily to form various assembled outlooks of the string that obtains decorative purpose. Now, accompanying with the following drawings, the character of the present invention will be described here and after.

DETAILED DESCRIPTION OF THE PREFERRED EMBODIMENT

Figure 1:
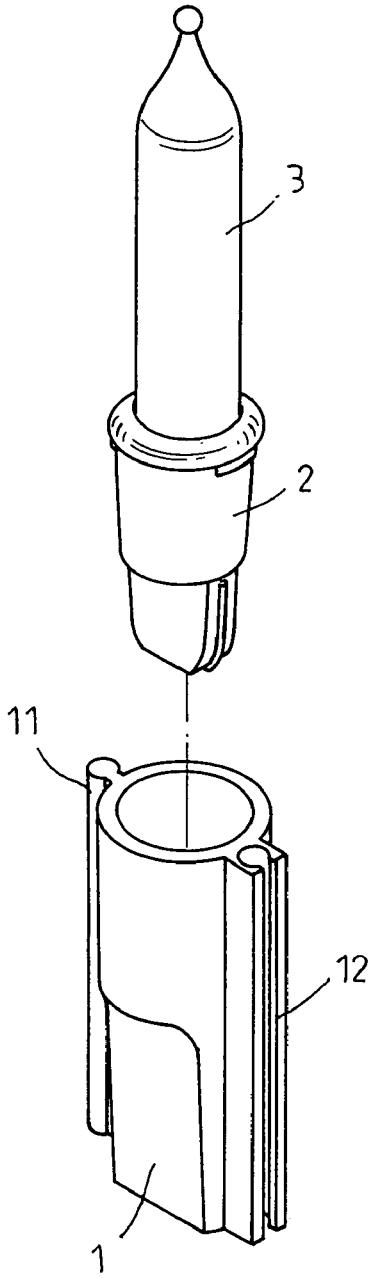
FIG. 1 is an exploded perspective view showing a bulb assembly according to the present invention.
Figure 2:
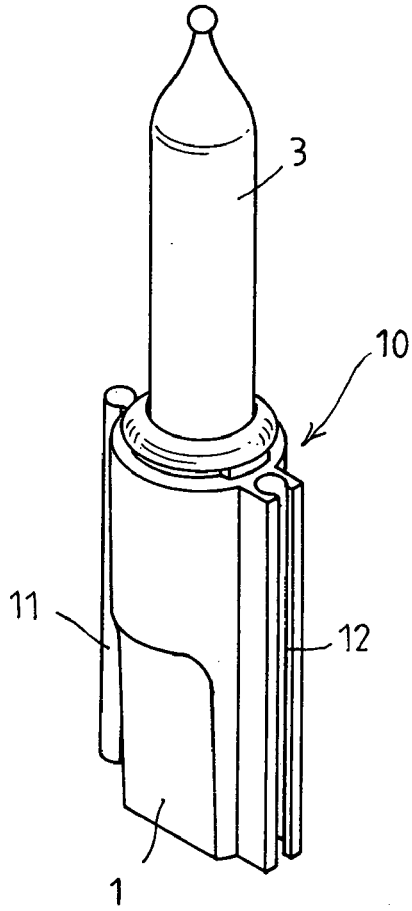
FIG. 2 is an assembled perspective view of FIG. 1.

Please refer to FIGS. 1 and 2; the present invention discloses a bulb assembly (10), which includes a shell (1), a bulb holder (2), and a bulb (3). The bulb (3) is received in the holder (2), which is then assembled in the shell (1). Each bulb assembly (10) is connected with an electrical wire to become a light string for decoration. The improvement of the present invention is in that the shell (1) is provided with a male flange (11) and a female groove (12) at the opposite sides. Therefore, each shell (1) of a bulb assembly (10) is able to connect its male flange (11) with a groove (12) of another shell (1) of the related bulb assembly (10) and to connect its female groove (12) with a related flange (11) of another shell (1). Accordingly, every bulb assembly (10) of a light string is able to connect with each other to become a stable connective status of the bulb assembly (10).

Figure 3:
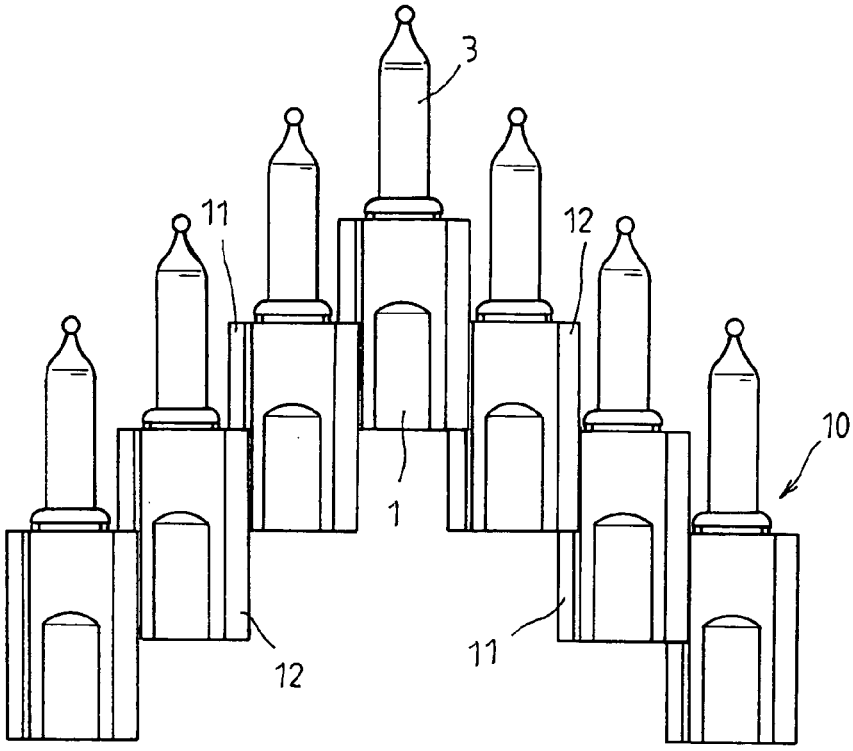
FIG. 3 is a schematic view showing an embodiment of the light string according to the present invention.
Figure 4:
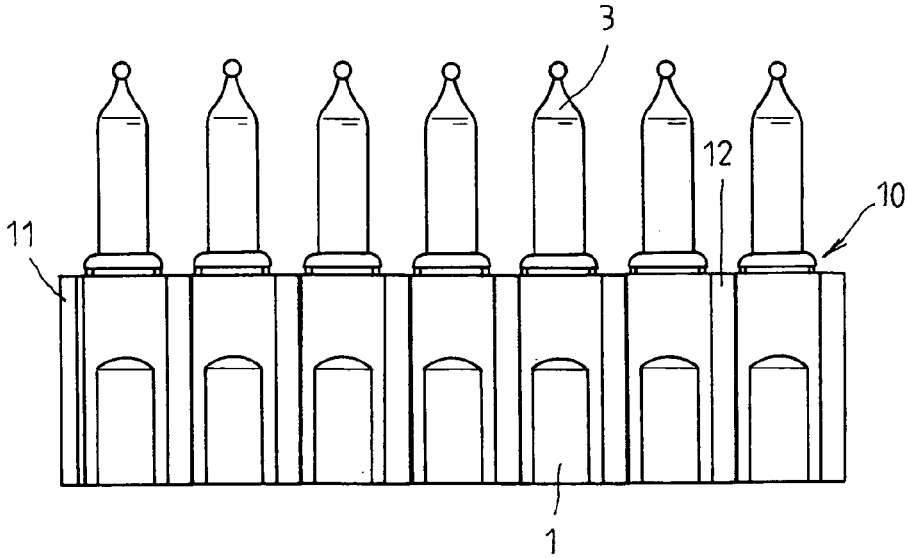
FIG. 4 is a schematic view showing a various connective status of the light string according to the present invention.

For example, as shown in FIG. 3 or 4, the present invention can become a stable connective status by the connection between each bulb assembly. When the connecting position is different, the string shows a different connective outlook. It is to be understood that various connective status of the light string can be achieved by adjusting the connecting position of the shell of each bulb assembly. The connecting configuration is stable without any rigid frame that increases the effect of utility.

I claim:

1. A light string with various connective elements, comprising a plurality of bulb assemblies electrically connected together in a string, each bulb assembly including a bulb, a bulb holder receiving said bulb therein, and a longitudinally extended shell receiving said bulb holder with said bulb therein, said shell having a male flange extending longitudinally on one side thereof and a female groove extending longitudinally on another side of said shell, wherein at least a portion of said male flange of one of said plurality of bulb assemblies is engageable with a respective portion of said female groove of another of said plurality of bulb assemblies to releasably join one to the other.

2. The light string as recited in claim 1, wherein said female groove is formed on a side of said shell opposing said side having said male flange formed thereon.

3. The light string as recited in claim 1, wherein said one of said plurality of bulb assemblies is engaged said other of said plurality of bulb assemblies and longitudinally offset with respect thereto.

4. The light string as recited in claim 1, wherein each of said male flange and female groove extend between opposing longitudinal ends of said shell.

* * * * *